US010258855B1

(12) United States Patent
DiMartino

(10) Patent No.: US 10,258,855 B1
(45) Date of Patent: Apr. 16, 2019

(54) TACKLE INDICATING ASSEMBLY

(71) Applicant: Michael DiMartino, Staten Island, NY (US)

(72) Inventor: Michael DiMartino, Staten Island, NY (US)

( * ) Notice: Subject to any disclaimer, the term of this patent is extended or adjusted under 35 U.S.C. 154(b) by 0 days.

(21) Appl. No.: 15/806,480

(22) Filed: Nov. 8, 2017

(51) Int. Cl.
*A63B 67/00* (2006.01)

(52) U.S. Cl.
CPC ..... *A63B 67/002* (2013.01); *A63B 2209/00* (2013.01); *A63B 2209/08* (2013.01)

(58) Field of Classification Search
CPC ..... A63B 71/00; A63B 67/00; A63B 67/06; A41F 1/00; A44B 11/04
USPC ..... 473/502, 585; 24/197; 2/322
See application file for complete search history.

(56) References Cited

U.S. PATENT DOCUMENTS

| | | | | |
|---|---|---|---|---|
| 2,986,396 | A | 5/1961 | Abbott | |
| 3,251,109 | A | 5/1966 | Wilson | |
| D302,626 | S | 8/1989 | Robinson | |
| 7,146,651 | B1 | 12/2006 | Lapin | |
| 7,817,002 | B2 | 10/2010 | Fullerton | |
| 2009/0042675 | A1* | 2/2009 | Baun, II | A63B 67/00 473/502 |
| 2012/0216333 | A1 | 8/2012 | Dewese | |
| 2013/0055532 | A1* | 3/2013 | Chapron | A44B 11/04 24/197 |
| 2013/0109513 | A1* | 5/2013 | Fernandez | A63B 67/06 473/585 |
| 2015/0237938 | A1* | 8/2015 | O'Neill | A41F 1/002 2/322 |
| 2016/0045798 | A1* | 2/2016 | Holland | A63B 67/002 473/502 |

* cited by examiner

*Primary Examiner* — Gene Kim
*Assistant Examiner* — Christopher Glenn

(57) ABSTRACT

A tackle indicating assembly for flag football players includes a belt that is configured to position around and couple to a waist of a user. Each of a plurality of straps has a terminus that is configured to selectively magnetically couple to the belt. The straps are configured to be grasped in a hand of a tackler so that each strap is positioned to separate from the belt to indicate a tackle of the user.

10 Claims, 4 Drawing Sheets

TACKLE INDICATING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to indicating assemblies and more particularly pertains to a new indicating assembly for flag football players.

BRIEF SUMMARY OF THE INVENTION

An embodiment of the disclosure meets the needs presented above by generally comprising a belt that is configured to position around and couple to a waist of a user. Each of a plurality of straps has a terminus that is configured to selectively magnetically couple to the belt. The straps are configured to be grasped in a hand of a tackler so that each strap is positioned to separate from the belt to indicate a tackle of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
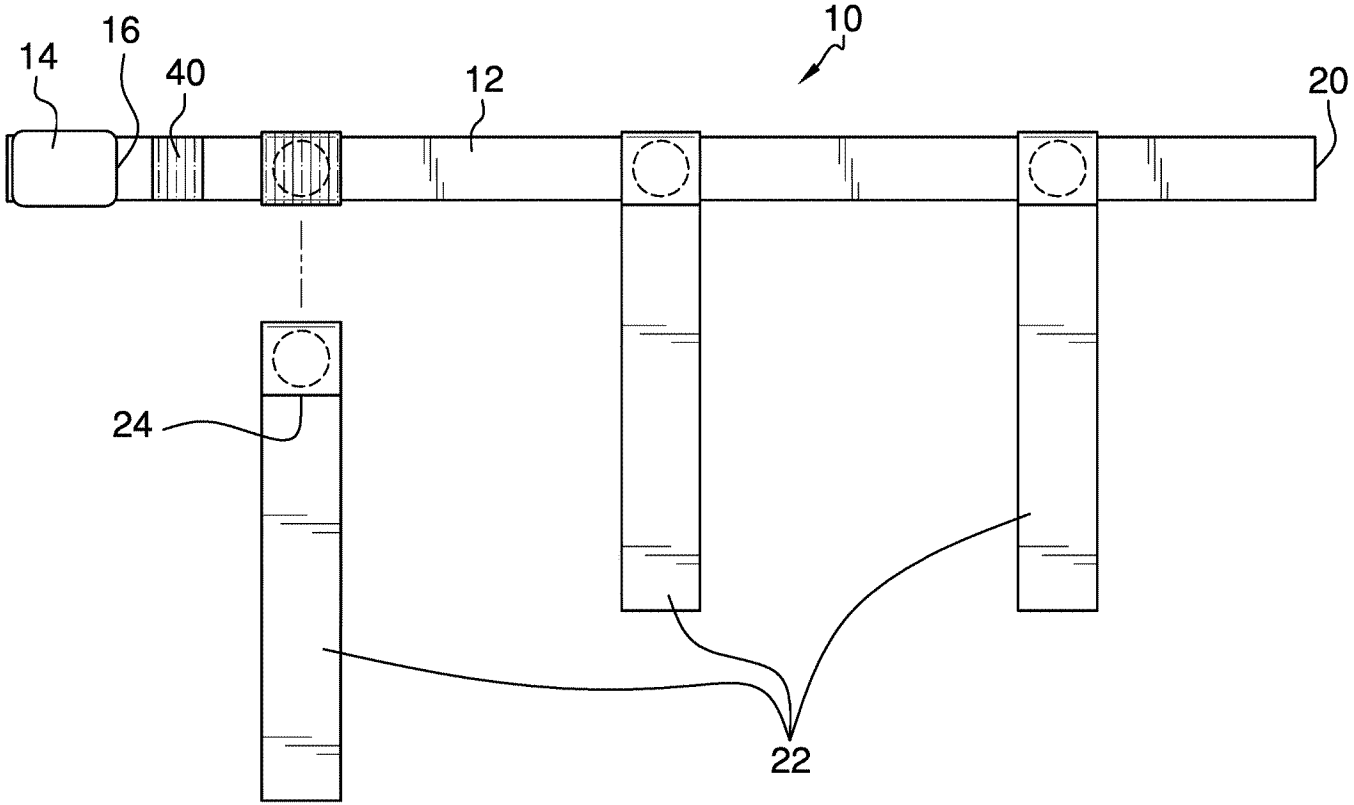
FIG. 1 is a front view of a tackle indicating assembly according to an embodiment of the disclosure.
Figure 2:
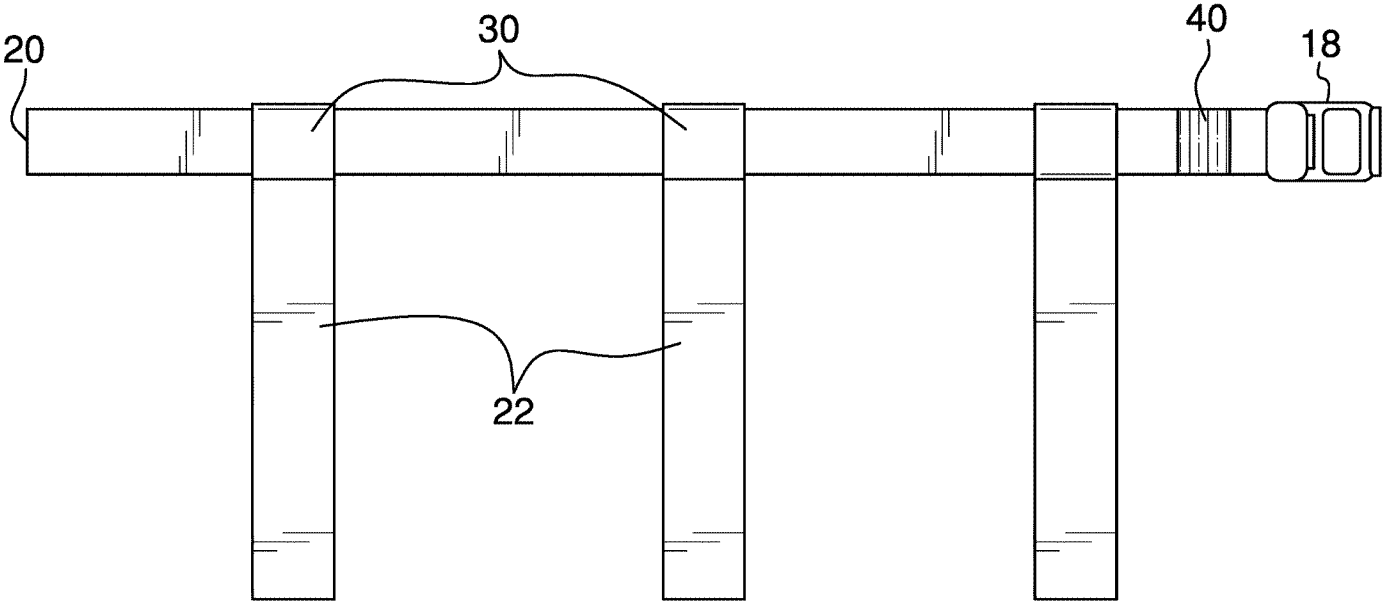
FIG. 2 is a back view of an embodiment of the disclosure.
Figure 3:
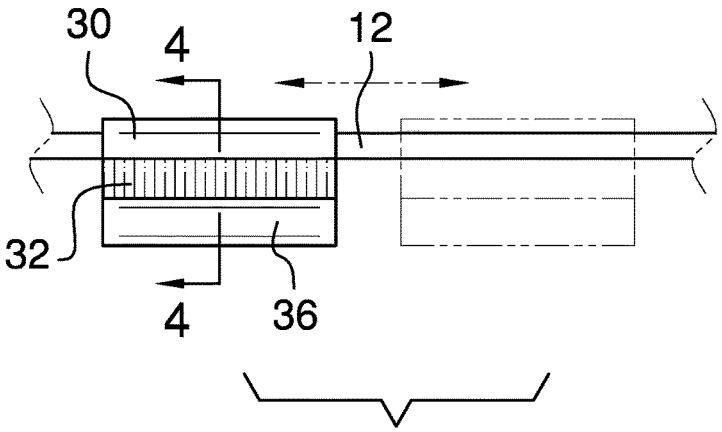
FIG. 3 is a detail view of an embodiment of the disclosure.
Figure 4:
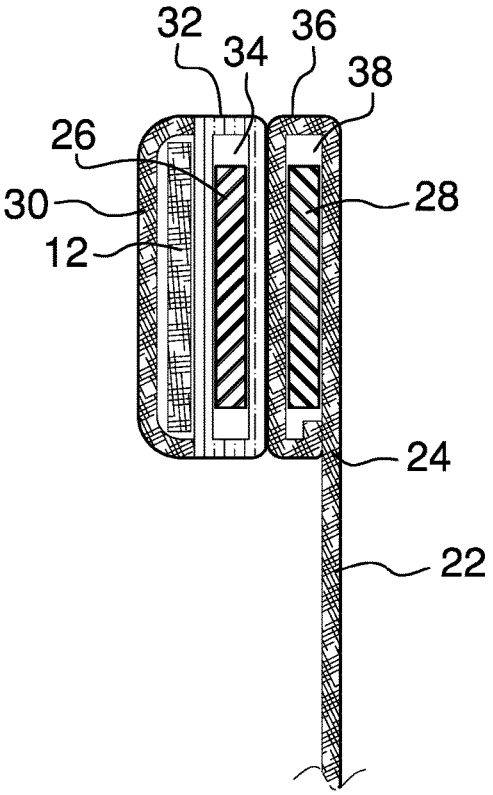
FIG. 4 is a cross-sectional view of an embodiment of the disclosure.
Figure 5:
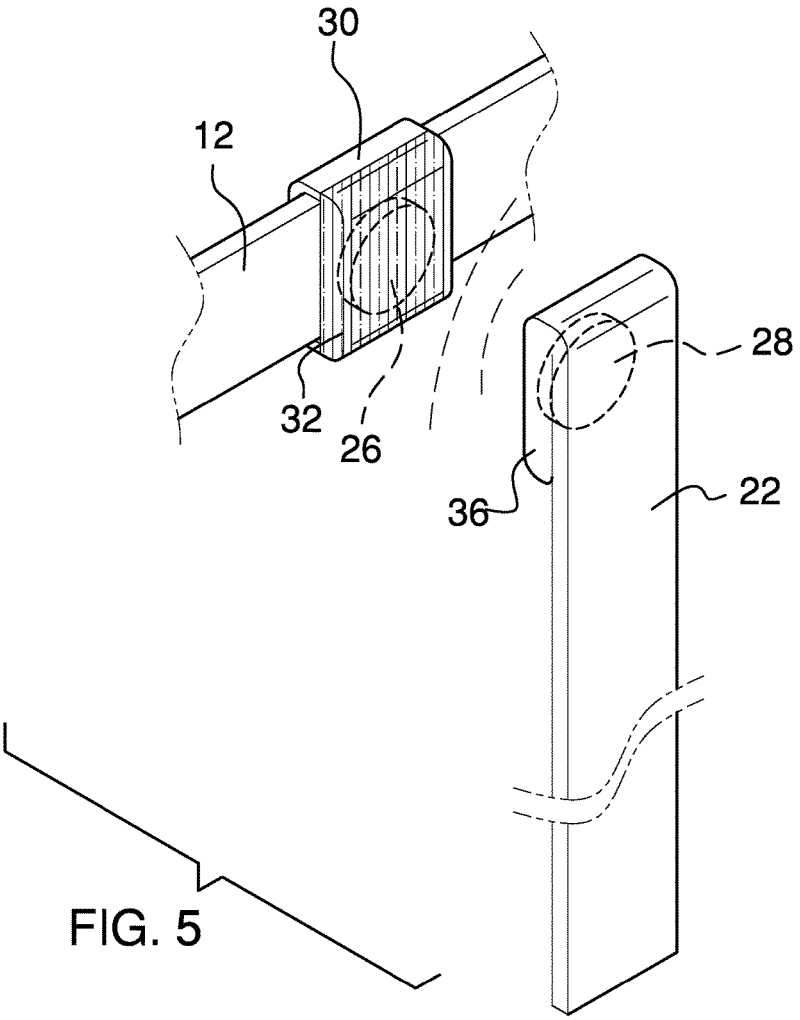
FIG. 5 is an isometric perspective view of an embodiment of the disclosure.

With reference now to the drawings, and in particular to FIGS. 1 through 5 thereof, a new indicating assembly embodying the principles and concepts of an embodiment of the disclosure and generally designated by the reference numeral 10 will be described.

As best illustrated in FIGS. 1 through 5, the tackle indicating assembly 10 generally comprises a belt 12 that is configured to position around and couple to a waist of a user. In one embodiment, the belt 12 comprises canvas nylon.

A connector 14 is coupled to a first end 16 of the belt 12. The connector 14 is selectively couplable to the belt 12 to couple the belt 12 around the waist of the user. In one embodiment, the connector 14 comprises a ratchet buckle 18. The ratchet buckle 18 is positioned to insert a second end 20 of the belt 12 and to be ratcheted to tighten the belt 12 around the waist of the user.

Each of a plurality of straps 22 has a terminus 24 that is configured to selectively magnetically couple to the belt 12. The straps 22 are configured to be grasped in a hand of a tackler. Each strap 22 is positioned to be separated from the belt 12 to indicate a tackle of the user. In one embodiment, the plurality of straps 22 comprises three straps 22. The straps 22 are positionable singly proximate to each hip of the user and centrally on a back of the user. In another embodiment, the straps 22 comprise vinyl coated polyester.

A plurality of first magnets 26 is coupled to the belt 12. Each of a plurality of second magnets 28 is coupled to a respective strap 22 proximate to the terminus 24. The second magnets 28 are opposingly polarized to the first magnets 26. Each second magnet 28 is positioned to magnetically couple to a respective first magnet 26 to couple the respective strap 22 to the belt 12. In one embodiment, the first magnets 26 and the second magnets 28 comprises neodymium.

Each of a plurality of first sleeves 30 is positioned around and is slidably coupled to the belt 12. Each of a plurality of first shells 32 is coupled to a respective first sleeve 30. Each first shell 32 is selectively positionable on the belt 12. Each first shell 32 defines an interior space 34. Each first magnet 26 is positioned in the interior space 34 of an associated first shell 32. In one embodiment, the first shells 32 comprise elastic.

Each of a plurality of second shells 36 is coupled to a respective strap 22 proximate to the terminus 24. Each second shell 36 defines an internal space 38. Each second magnet 28 is positioned in the internal space 38 of an associated second shell 36. Each second magnet 28 is positioned to selectively couple to a respective first magnet 26 that is positioned on the belt 12.

A second sleeve 40 is positioned around and is slidably coupled to the belt 12. The second sleeve 40 is positioned to insert the second end 20 of the belt 12 to couple the belt 12 to the belt 12 to prevent the belt 12 from dangling.

In use, the ratchet buckle 18 is positioned to insert the second end 20 of the belt 12 and to be ratcheted to tighten the belt 12 around the waist of the user. The second sleeve 40 is positioned to insert the second end 20 of the belt 12 to couple the belt 12 to the belt 12 to prevent the belt 12 from dangling. Each second magnet 28 is positioned to magnetically couple to the respective first magnet 26 to couple the respective strap 22 to the belt 12. The straps 22 that are positioned on the belt 12 are configured to be grasped in the hand of the tackler. Each strap 22 is positioned to be separated from the belt 12 to indicate the tackle of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tackle indicating assembly comprising:

a belt configured for positioning around and coupling to a waist of a user;

a plurality of straps, each said strap having a terminus configured for selectively magnetically coupling to said belt;

wherein said straps are positioned on said belt such that said straps are configured for grasping in a hand of a tackler such that each said strap is positioned for separating from said belt for indicating a tackle of the user;

a plurality of first magnets coupled to said belt;

a plurality of second magnets, each said second magnet being coupled to a respective said strap proximate to said terminus, said second magnets being opposingly polarized to said first magnets;

wherein each said second magnet is positioned for magnetically coupling to a respective said first magnet for coupling said respective said strap to said belt;

a plurality of first sleeves positioned around and slidably coupled to said belt;

a plurality of first shells, each said first shell defining an interior space, each said first magnet being positioned in said interior space of an associated said shell, each said first shell being coupled to a respective said first sleeve;

a plurality of second shells, each said second shell being coupled to a respective said strap proximate to said terminus, each said second shell defining an internal space, each said second magnet being positioned in said internal space of an associated said second shell; and wherein said first shells are positioned on said first sleeves such that each said first shell is selectively positionable on said belt, wherein said second shells are positioned on said straps such that each said second magnet is positioned for selectively coupling to a respective said first magnet positioned on said belt.

2. The assembly of claim 1, further including said belt comprising canvas nylon.

3. The assembly of claim 1, further including a connector coupled to a first end of said belt, said connector being selectively couplable to said belt for coupling said belt around the waist of the user.

4. The assembly of claim 3, further including said connector comprising a ratchet buckle, wherein said ratchet buckle is positioned on said belt such that said ratchet buckle is positioned for inserting a second end of said belt and for ratcheting for tightening said belt around the waist of the user.

5. The assembly of claim 1, further including said first magnets and said second magnets comprising neodymium.

6. The assembly of claim 1, further including said first shells comprising elastic.

7. The assembly of claim 1, further comprising:

said belt having a first end and a second end; and a second sleeve positioned around and slidably coupled to said belt, wherein said second sleeve is positioned on said belt such that said second sleeve is positioned for inserting said second end of said belt for coupling said belt to said belt for preventing said belt from dangling.

8. The assembly of claim 1, further including said plurality of straps comprising three said straps such that straps are positionable singly proximate to each hip of the user and centrally on a back of the user.

9. The assembly of claim 1, further including said straps comprising vinyl coated polyester.

10. A tackle indicating assembly comprising:

a belt configured for positioning around and coupling to a waist of a user, said belt comprising canvas nylon;

a connector coupled to a first end of said belt, said connector being selectively couplable to said belt for coupling said belt around the waist of the user, said connector comprising a ratchet buckle, wherein said ratchet buckle is positioned on said belt such that said ratchet buckle is positioned for inserting a second end of said belt and for ratcheting for tightening said belt around the waist of the user;

a plurality of first magnets coupled to said belt, said first magnets comprising neodymium;

a plurality of first sleeves positioned around and slidably coupled to said belt;

a plurality of first shells, each said first shell defining an interior space, each said first magnet being positioned in said interior space of an associated said shell, each said first shell being coupled to a respective said first sleeve, wherein said first shells are positioned on said first sleeves such that each said first shell is selectively positionable on said belt, said first shells comprising elastic;

a second sleeve positioned around and slidably coupled to said belt, wherein said second sleeve is positioned on said belt such that said second sleeve is positioned for inserting said second end of said belt for coupling said belt to said belt for preventing said belt from dangling;

a plurality of straps, each said strap having a terminus configured for selectively magnetically coupling to said belt, wherein said straps are positioned on said belt such that said straps are configured for grasping in a hand of a tackler such that each said strap is positioned for separating from said belt for indicating a tackle of the user, said plurality of straps comprising three said straps such that straps are positionable singly proximate to each hip of the user and centrally on a back of the user, said straps comprising vinyl coated polyester;

a plurality of second magnets, each said second magnet being coupled to a respective said strap proximate to said terminus, said second magnets being opposingly polarized to said first magnets such that each said second magnet is positioned for magnetically coupling to a respective said first magnet for coupling said respective said strap to said belt, said second magnets comprising neodymium;

a plurality of second shells, each said second shell being coupled to a respective said strap proximate to said terminus, each said second shell defining an internal space, each said second magnet being positioned in said internal space of an associated said second shell, wherein said second shells are positioned on said straps such that each said second magnet is positioned for selectively coupling to a respective said first magnet positioned on said belt; and wherein said ratchet buckle is positioned on said belt such that said ratchet buckle is positioned for inserting said second end of said belt and for ratcheting for tightening said belt around the waist of the user, wherein said second sleeve is positioned on said belt such that said second sleeve is positioned for inserting said second end of said belt for coupling said belt to said belt for preventing said belt from dangling, wherein each said second magnet is positioned for magnetically coupling to said respective said first magnet for coupling said respective said strap to said belt, wherein said straps are positioned on said belt such that said straps are configured for grasping in the hand of the tackler such that each said strap is positioned for separating from said belt for indicating the tackle of the user.

* * * * *